United States Patent [19]

Goodman et al.

[11] 4,042,986

[45] Aug. 23, 1977

[54] BODY SUPPORTING AND CUSHIONING SURFACE FOR BEDDING

[75] Inventors: Steven J. Goodman, San Clemente; Angel M. Echevarria, La Crescenta, both of Calif.

[73] Assignee: Angel M. Echevarria, La Crescenta, Calif.

[21] Appl. No.: 664,252

[22] Filed: Mar. 5, 1976

[51] Int. Cl.[2] ..... A47G 9/00

[52] U.S. Cl. ..... 5/335; 5/355

[58] Field of Search ..... 5/335, 345 R, 351, 355, 5/361 R, 334 C, 334 R

[56] References Cited

U.S. PATENT DOCUMENTS

| | | | |
|---|---|---|---|
| 3,027,573 | 4/1962 | Bell | 5/351 |
| 3,200,418 | 8/1965 | Lefens | 5/351 |
| 3,287,749 | 11/1966 | Mansico | 5/351 |
| 3,774,250 | 11/1973 | Miller | 5/345 R |

*Primary Examiner*—Casmir A. Nunberg

*Attorney, Agent, or Firm*—Fraser and Bogucki

[57] ABSTRACT

A marked improvement in the body supportive and cushioning functions of a mattress is provided by superimposing a torsionally resistant, marginally restrained, resilient buffer surface of defined thickness and finite compressibility on the mattress. The buffer surface comprises at least one layer of repeatedly impacted foam having density and thickness within predetermined ranges, quilted together with a ticking and a porous backing, and including fitted borders with tensioning means. This buffer surface has a superficial softness but underlying resilience that give a luxurious feeling. The quilting creates localized compression zones, and the impacted characteristic of the foam after quilting provides a resilient structure that has physical integrity and unity. Even if the mattress is stiff or sagging, or has a worn or button tufted surface, the use of the buffer surface improves both comfort and body support characteristics. The buffer surface is, at the same time, low in cost, easily installed, and fully washable and driable.

8 Claims, 4 Drawing Figures

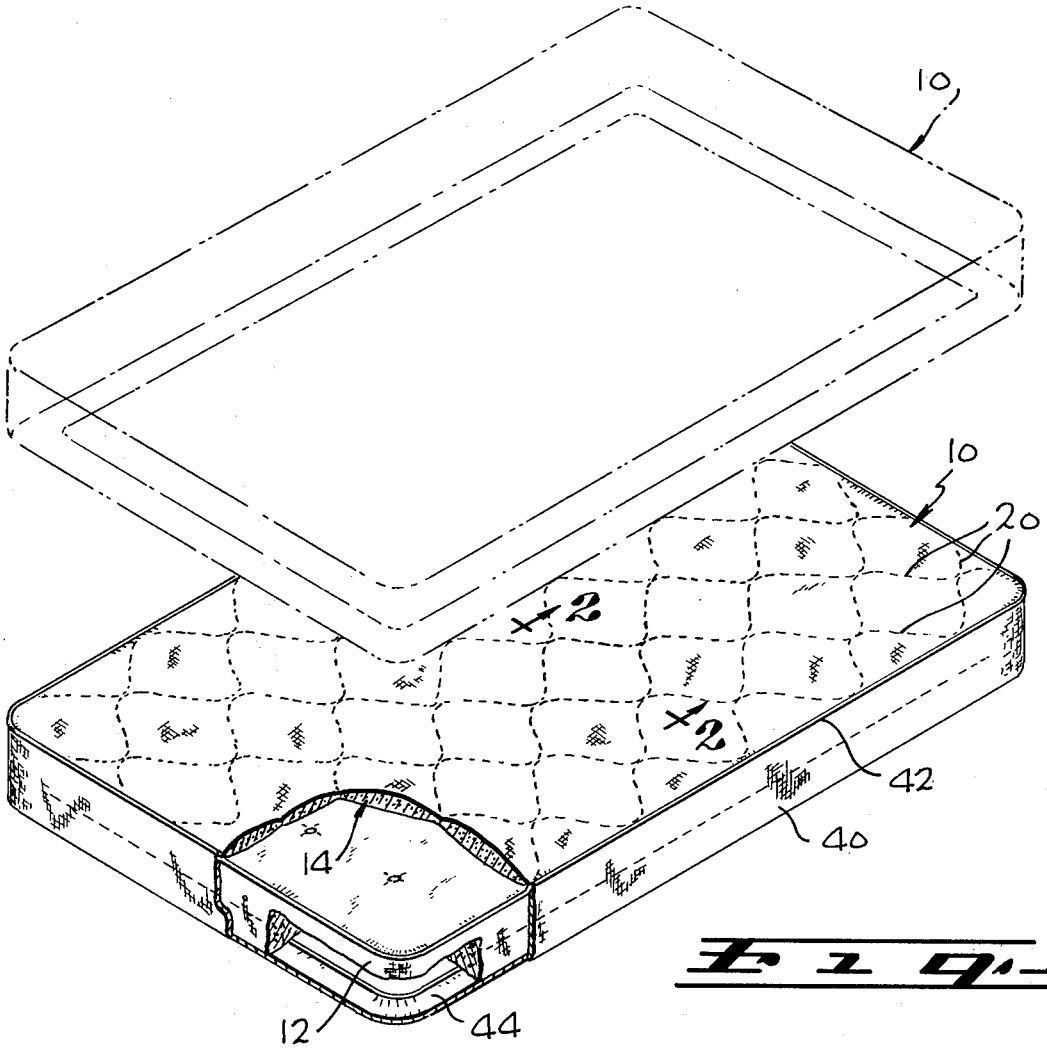
Fig. 1
Fig. 2
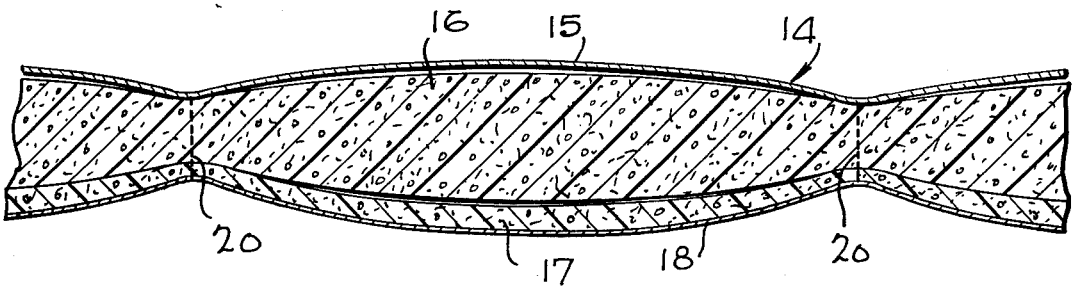

BODY SUPPORTING AND CUSHIONING SURFACE FOR BEDDING

BACKGROUND OF THE INVENTION

The cost of a mattress generally precludes frequent replacement by the average person, and repair is generally not practical. As a mattress undergoes normal usage, it begins to sag where it is frequently used, to develop uneven spots and also presents a nonuniform response to body weight. Such defects frequently occurs in the padding which forms and defines the upper surface of the mattress. Higher priced mattresses can become subject to the same difficulties, even though higher quality mattresses will have substantially more coils and be better supported and constructed. With any innerspring mattress, the combination of surface padding and interior springs is intended to provide both some degree of softness to the touch and adequate resilient conformity to the contours of the user's body, in accordance with desired firmness. Both factors are highly desirable for sleeping comfort. Even a person who wishes very firm support, for example, does not wish to be in direct contact with rigid surfaces which can quickly cause discomfort particularly to arms and hands when body weight rests upon them. As both padding and interior structure deteriorate with wear and usage of a mattress, however, there can be a substantial increase in discomfort because of changes in either or both of the surface response and body support functions.

Different techniques are widely used for providing limited improvements in mattress defects. Mattress pads, generally of thin quilted fabric, are employed primarily to supply a protective covering for mattresses. They concurrently act to increase the surface padding thickness slightly although there is neither appreciable softness or support, and they tend to become locally compressed or matted quite rapidly. Thin panels may be inserted for orthopaedic reasons above or below the mattress to provide greater firmness, but such expedients are directed only to limited functions. Foam pads have been superposed on mattresses, but foam pads of themselves when used in adequate thicknesses have a springy characteristic and a lateral shifting tendency that change the mattress response so that it has substantially more of a floating characteristic, which many people do not like. The need for a low cost, readily maintainable bedding unit of general applicability that provides conversion of a stiff, worn or sagging mattress to the more luxurious response and support of a high quality mattress, still remains.

SUMMARY OF THE INVENTION

Structures in accordance with the invention provide what may be termed a buffer surface which may be superimposed on an existing mattress to provide a marked improvement in sleeping comfort despite defects in the mattress itself. Buffer surfaces in accordance with the invention comprise foam interior structures quilted together with a ticking and a porous backing. The quilting operation, in conjunction with the thickness and resilience of the foam layer used, provides a forcibly impacted, partially modified foam interior having permanent compression along the quilt stitching lines. The buffer surface has a substantial degree of physical integrity and is resiliently compliant to downwardly directed forces while being resistant to torsional and twisting forces in its principal plane. Side borders are arranged to provide marginal restraint and close conformity to the mattress. The characteristics of the buffer surface so modify the response of the underlying mattress as to isolate the user from mattress imperfections, provide a soft initial response to the touch or body, and to provide uniform conforming response to body contours.

In a specific example of a buffer surface for bedding in accordance with the invention, a foam interior comprising a given upper thickness of lower density foam and a lesser lower thickness of a slightly higher density foam are quilted together with a commercial ticking and a porous backing. The quilting operation is specially arranged to accommodate a total thickness of material greater than has heretofore been done, and the multi-needle quilting operation also causes multiple forceful impacts throughout the area of the layers, to change the foam characteristics to enhance the softness of the surface. The localized compression imparted by the stitches of the quilting pattern contributes body support and unifies the layers. A fitting side border is employed about the periphery of the mattress, with an underside drawstring or elastic being disposed to tighten the entire buffer surface relative to the mattress. This combination is low in cost, has great durability, may be washed repeatedly, and dries readily. It provides the look of a new mattress, and a luxuriant soft-surfaced, interiorly-compressible feel and response that give a desirable combination of support and response.

BRIEF DESCRIPTION OF THE DRAWINGS

A better understanding of the invention may be had by reference to the following description, taken in conjunction with the accompanying drawings, in which:

FIG. 1 is a perspective view, partially broken away, of a buffer surface for bedding in accordance with the invention as disposed on a mattress, and illustrating the buffer surface itself in phantom;

FIG. 2 is a cross-sectional view, taken along the lines 2—2 in FIG. 1, and looking in the direction of the appended arrows, showing details of a fragment of one principal part of the buffer surface;

DETAILED DESCRIPTION OF THE INVENTION

Figure 3:
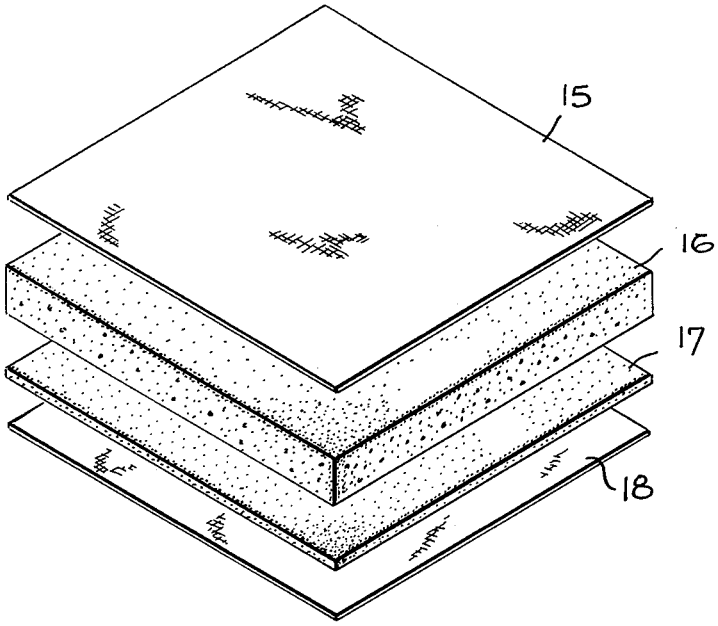
FIG. 3 is an exploded fragmentary view of principal elements utilized in a buffer surface in accordance with the invention.

A buffer surface 10 for bedding in accordance with the invention, as best seen in FIGS. 1-3, is to be superposed on the upper or superior surface of a mattress 12, as best seen in FIG. 1. The principal body of the buffer surface 10, referring now specifically to FIGS. 2 and 3, comprises a multilayer laminate 14 which consists of an upper surface of ticking material 15, an upper foam sheet 16, a lower foam sheet 17, and a bottom or inferior surface of backing fabric 18. While the ticking material 15 may comprise any suitable commercial washable fabric that is color fast and has minimal shrinkage, a 100% polyester material is advantageous for the present example in that it may readily be washed, printed in attractive patterns, and also has a smooth but not slippery finish. The upper and lower foam sheets 16, 17, are selected to provide a total thickness in the uncompressed form of between ¾ and 1¾ inch, and to provide a desired combination of self-support, physical integrity, softness, resilience, and comformability. To this end, the upper foam sheet 16 in this example is of approximately 1 inch closed cell polyurethane foam of nominal 1 lb/cu. ft. density, and having an indentation load deflection (ILD) of 7–12. The inferior foam sheet 17 is also a closed cell polyurethane foam of approximately, but of ¼ inch thickness, with a nominal density of 1.15 lb/cu. ft. and an indentation load deflection of 30–34. As is known by those skilled in the art, foam sheets are typically cut from a large foam casting or "bun", and densities may vary from the nominal in accordance with the zone from which the sheet is taken. Foam sheets are employed that are from 0.5 to 2.0 lbs/cu. ft. in nominal density, and preferably from 0.9 to 1.3 lbs/cu. ft. Suitable foam layers may comprise products sold under the "Polyfoam" trademark by General Tire and Rubber Co. In this example the backing fabric 18 comprises a nylon tricot fabric of 40/15 denier.

Figure 4:
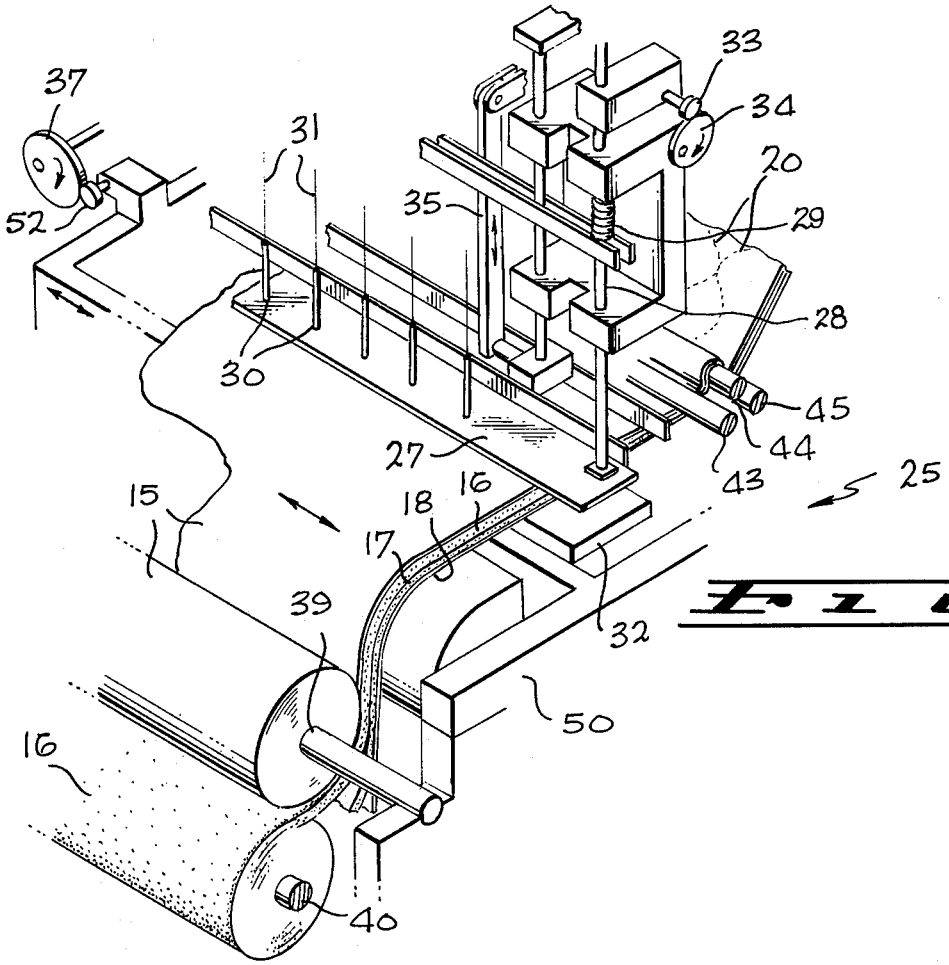
FIG. 4 is a combined partial perspective and broken away view of a simplified mechanism for quilting a portion of a buffer surface in accordance with the invention, showing the manner in which cyclic impacting and quilting are performed concurrently.

The multi-layer laminate 14 is both altered and unified by a quilting operation which results in an areal pattern of stitching 20 across the buffer surface 10. Along the lines of the stitching 20, the foam sheets 16, 17 are substantially compressed, maintaining a certain interior tension in the volumes adjacent the stitch lines. The stitching 20 also defines areal cells throughout the buffer surface 10, in that compression at one area does not cause substantial distortion at another. A further very useful change in the characteristics of the foam sheets 16, 17 is effected by the forcible repetitive impacting that takes place during quilting. It is believed that prior to the efforts of applicants, commercial quilting machines have not been employed to quilt foams in excess of ½ inch in thickness. However, as illustrated generally in FIG. 4, a quilting machine can be utilized for a substantially greater thickness of laminate, to provide a structure in accordance with the invention. The machine 25, depicted only in simplified form in FIG. 4, may comprise a modified Pathe multi-needle, 1 × 3 model, quilting machine. It includes a needle pressure foot 27 which is reciprocated vertically by guide rods 28 in timed relation to the advance and lateral shifting of the layers 15–18 for the quilted body that are to be moved through the machine. Vertically disposed needles 30 through which yarns 31 are threaded reciprocate vertically through apertures in the needle pressure foot 27 in timed relation to feedthrough of the quilted body and depression of the needle pressure foot 27. The needle pressure foot 27 impacts downward against the laminate at each step, compressing the interior foam against the upper surface of a needle plate 32 across which it moves. The impacting force is increased and the cycle time is reduced by compression springs 29 on the guide rods 28. A pressure foot lifter cam 33 mechanism controls the reciprocation of the pressure foot 27, this cam mechanism including a rotating cam lobe 34 that provides approximately twice the extent of vertical travel of the pressure foot in known quilting machines. A connecting rod 35 coupled to a conventional needle bar block and needle bar assembly supporting the needles 30 is reciprocated vertically in synchronism with movement of the pressure foot 27. A number of guide rods 28 and connecting rods 35 are disposed along the span of the pressure foot 27, but only one of each has been shown for simplicity.

Concurrently, a drive cam 37 of selected configuration for the particular quilting pattern being generated introduces transverse motion of the quilted body relative to the pressure foot 27. Supply rollers 39, 40 (only two of which are shown) for the layers 15–18, feed rollers 43, 44, 45 adjacent the pressure foot 27 and a takeup reel (not shown) are mounted on a carriage 50 which is reciprocated by a cam follower 52 engaging the drive cam 37. The mechanism has been simplified for clarity and brevity in FIG. 4 inasmuch as it need only be appreciated that a relatively thick multi-layer laminate can in fact be quilted.

In the operation of the quilting machine 25, the needle pressure foot 27 repeatedly impacts on a given incremental area of the quilted laminate as it is advanced. With a 4 inch pressure foot 27, and with 10 stitches per inch, each point on the laminate is impacted 40 times. Further, the compression is in excess of 90% of the original thickness because of the weight of the needle plate 32 structure and the force of the compression springs 29. This impacting causes a controlled change of the wall characteristics of the interior cellular structure, without affecting the geometry of the cells. The impacting action reduces cellular wall stiffness, and stabilizes the response which should otherwise gradually shift with usage. While enhancing the superficial softness of the buffer surface, there is no material reduction of strength or physical integrity, and no adverse effect on the underlying resiliency of the unit under compression.

A side border 40, referring again to FIG. 1, extends about the periphery of the buffer surface 10 and is secured by sewing to the ticking material 15 and backing fabric 18 along a border 42 which may comprise a conventional ⅞ inch mattress tape. The inner margin of the side panel 40 underlies the edge of the mattress 12 about its periphery, and may be tightened by a drawstring 44 or an elastic cord (not shown). When so secured, the buffer surface 10 completely covers the mattress in form fitting fashion, giving it the appearance of a wholly new mattress, which can be aided by an attractive pattern on the upper surface of the ticking 15. The buffer surface 10 further has a substantial amount of independent structural integrity, so that it does not follow the sags and irregularities of the underlying mattress 12. The areal cells defined by the quilting pattern and the marginal restraint at its periphery make the buffer surface 10 resistant to torsional and twisting forces, such as a sleeper exerts when turning or rolling over. Each areal cell is mechanically isolated to a degree from the adjacent cells so that a downward force in one area compresses only that area without tending to draw in or tension material from the surrounding areas. The initial response to pressure, such as hand pressure, is thus soft and yielding in character, but as more pressure is exerted the underlying resilience is encountered. The result is a combination of conformity to the body with independent supplementary support that is uniquely suited to a bedding function, because it presents luxurious surface feel and also comfortable body support while isolating the user from the irregularities of the underlying mattress 12. The quilting, which defines approximate rectangular or diamond patterns of about 3 to 6 inches on a side, is generally considered to have a more pleasing aesthetic appearance than a flat surface. The individual areal cells defined by the quilting act in the fashion of independent springs, and the compression lines along the stitching can permit some air circulation where not highly compressed. This effect can be accentuated by decreasing the cell size, but at increased cost of material. The relatively thinner and less deflective lower foam sheet 17 aids in isolating the user from the mattress, and aids also in distributing load forces without introducing stiffness. These factors together with the soft surface rejuvenate the characteristics of an old, worn, or sagging mattress. The user is isolated from the lumps or ridges of a worn mattress, or one that has protruding springs or button tufting. These factors also create a feeling of comfort and luxury even with a too firm mattress.

In addition to being readily installable and removable, the buffer surface 10 is completely washable in a unit of suitable size. The porous backing 18 is completely permeable to water, which penetrates but readily escapes from the surface portions of the closed cellular structure of the foam sheets 16, 17 so that the water readily drains out during a drying operation. Buffer surfaces in accordance with the invention have been certified by the Institute of Fabricare for washability and driability.

Another highly desirable characteristic is that the buffer surface has extremely long life and wear characteristics. Structures in accordance with the invention have been life tested with artificial mannequins (equivalent to a 175 lb. person) undergoing torsion, impacting and twisting sequences for in excess of 12,000 cycles. Even after this length of testing time the products have retained their resiliency and have not shown excess signs of wear, indicating a normal life in usage of in excess of six to seven years.

Although a number of modifications and variations have been described above, it will be appreciated that the invention is not limited thereto but encompasses all forms and variations falling within the scope of the appended claims.

What is claimed is:

1. A cushioning and support buffer surface having a quilted appearance for placement on the superior surface of a mattress to enhance uniformity, conformability response, and support for a user, comprising:

cellular foam panel means having a thickness of approximately ¾ to 1¾ inches and a density of from 0.5 to 2.0 lbs/cu. ft., said foam panel having a forcibly impacted structure and comprising a pair of cyclically impacted closed cell foam sheets of different densities, the lower sheet being of lesser thickness and greater density and the indentation load deflections of said sheets being less than 35;

superior surface ticking means and inferior surface porous backing means disposed on opposite sides of said panel means;

quilting stitch means areally unifying said ticking means and backing means to said panel means, and compressing said panel means along stitch lines; and side border means coupled to said panel means and providing marginal restraint of said panel means to the associated mattress.

2. The invention as set forth in claim 1 above, wherein the upper foam sheet is of approximately 1 inch in thickness and wherein the lower foam sheet is of approximately ¼ inch in thickness.

3. The invention as set forth in claim 2 above, wherein the upper foam sheet is polyurethane sheet of approximately 1.00 lb/ft$^3$ density and an indentation load deflection of 7–12, and the inferior foam sheet is of approximately 1.15 lb/ft$^3$ density and an indentation load deflection of 30–34.

4. The invention as set forth in claim 3 above, wherein the ticking is of polyester fabric and the backing is a nylon tricot, and wherein in addition said buffer surface comprises a mattress tape border coupling said ticking means to said side border means.

5. The invention as set forth in claim 1 above, wherein said side border means comprises fitted skirt means including a margin underlying the mattress to which it is fitted, and means engaging the underlying margin for tightening the side border means into firm engagement with the mattress.

6. A bedding article for affixation to a mattress, to substantially improve the response and conformability for a user, comprising:

a washable top surface member having a principal thickness of ¾ to 1¾ inches and including at least one interior polyurethane foam sheet having a density of from 0.90 to 1.30 lbs/ft$^3$, said panel having a forcibly impacted interior structure and including quilt-stitching means permanently compressing the panel along generally spaced apart stitching lines; and washable border means secured to said top surface panel and including means for fitting to the sides of the mattress.

7. The invention as set forth in claim 6 above, wherein said top surface member comprises a pair of foam sheets, including an upper sheet of relatively lower density having a lesser density than a lower sheet of relatively higher density.

8. The invention as set forth in claim 7 above, wherein the upper sheet is of approximately 1 inch in thickness and approximately 1.00 lbs/ft$^3$ in density and wherein the lower sheet is of approximately ¼ inch in thickness and approximately 1.15 lbs/ft$^3$ in density.

* * * * *

UNITED STATES PATENT AND TRADEMARK OFFICE

CERTIFICATE OF CORRECTION

PATENT NO. : 4,042,986

DATED : August 23,1977

INVENTOR(S) : Steven J. Goodman and Angel M. Echevarria

It is certified that error appears in the above-identified patent and that said Letters Patent are hereby corrected as shown below:

Under "United States Patent [19]", "Goodman et al" should read --Echevarria et al--.

After "[75] Inventors:", "Steven J. Goodman, San Clemente, Angel M. Echevarria, La Crescenta, both of Calif."

should read --Angel M. Echevarria, La Crescenta, Steven J. Goodman, San Clemente, both of Calif.--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*